United States Patent [19]

Convey, Jr.

[11] Patent Number: 4,498,381

[45] Date of Patent: Feb. 12, 1985

[54] SIGNATURE TRANSFER VEHICLE WITH STACK CLAMPING MECHANISM

[75] Inventor: Frank H. Convey, Jr., Peru, N.Y.

[73] Assignee: Harris Graphics Corporation, Melbourne, Fla.

[21] Appl. No.: 518,014

[22] Filed: Jul. 28, 1983

[51] Int. Cl.[3] ..... B30B 15/06

[52] U.S. Cl. ..... 100/100; 100/7; 100/255; 100/264; 100/295; 414/43

[58] Field of Search ..... 100/231, 291, 255, 264, 100/295, 7, 244, 232, 100; 414/43, 907, 110

[56] References Cited

U.S. PATENT DOCUMENTS

| | | | |
|---|---|---|---|
| 2,933,314 | 4/1960 | Stobb | 100/7 X |
| 2,982,063 | 5/1961 | Coleman | 100/264 X |
| 3,825,134 | 7/1974 | Stobb | 414/43 X |
| 3,853,234 | 12/1974 | Stobb | 414/110 |
| 4,140,052 | 2/1979 | Meier | 100/264 X |

*Primary Examiner*—Billy J. Wilhite

*Attorney, Agent, or Firm*—Yount & Tarolli

[57] ABSTRACT

A transfer vehicle with a special clamping mechanism for clamping a stack of signatures supported on a stacker, and for maintaining clamping engagement with the stack as the transfer vehicle moves the stack to a delivery position. The clamping mechanism can bring an end board over to the stacker, and deposits the end board on the stacker as the clamping mechanism engages a stack. The clamping mechanism also has independently movable clamp members that can move to different coextents in applying pressures to different portions of a stack of signatures during the clamping process. Still further, the clamping mechanism is designed to positively contain a signature stack that is removed from a stacker.

6 Claims, 12 Drawing Figures

SIGNATURE TRANSFER VEHICLE WITH STACK CLAMPING MECHANISM

BACKGROUND OF THE INVENTION

This application relates to a transfer vehicle with a stack clamping mechanism for engaging and clamping a stack of signatures supported on a stacker. It relates particularly to a stack clamping and transfer mechanism for use in a signature handling apparatus as shown in the twp occurrences invention disclosure of James Wise entitled "Signature Handling Apparatus", application Ser. No. 525,840, which is assigned to the assignee of this invention.

In the aforesaid application of James Wise, a stack transfer vehicle can move between a stack pickup position and a stack delivery position. At the stack pickup position, a clamping mechanism carried on the transfer vehicle clamps a stack of signatures supported on a stacker, and withdraws the stack of signatures from the stacker. The transfer vehicle then transports the stack of signatures to a delivery station while maintaining positive engagement with the stack, and releases the stack of signatures at the delivery location.

A specific improvement for the aforesaid system of James Wise is shown in a concurrently filed application of Mohanjit Chandhoke and Michael Duke, entitled "Apparatus For Forming A Stack Of Signatures", U.S. application Ser. No. 518,015, and also assigned to the assignee of this application. In that improvement, a stack of signatures are formed from an incoming stream, and an end board is associated with end of the stack. When a stack is completed, it is deposited onto an intermediate member in position to be picked up by the transfer vehicle. As the clamping mechanism moves over to a stacker to pick up a stack, it carries with it an end board for use with a succeeding stack. When the clamping mechanism is at the stacker, the end board is deposited with the stacker, and the stacker associates that end board with a succeeding stack.

SUMMARY OF THE INVENTION

The present invention relates to a transfer vehicle with a special clamping mechanism for clamping a stack of signatures supported on a stacker, and for maintaining clamping engagement with the stack as the transfer vehicle moves the stack to a delivery position. The clamping mechanism of the invention is particularly useful in a system that incorporates the basic principles of the aforesaid disclosure of Mr. Wise and the additional principles of the aforesaid disclosure of Messrs. Chandhoke and Duke.

In one aspect of the present invention, the clamping mechanism not only brings an end board over to the stacker, but also contains a means which strips the end board therefrom and deposits the end board on the stacker as the clamping mechanism engages a stack. The clamping mechanism is designed to hold an end board as the clamping mechanism is moving to the stacker, and the clamping mechanism further includes a stripping means which strips the end board therefrom as the clamping mechanism clamps a stack of signatures.

In another aspect of the invention, the clamping mechanism has a pair of clamping assemblies that move toward each other to clamp a stack of signatures, and at least one of the clamping assemblies comprises a pair of clamp members which are actuated simultaneously, but can move independently of one another. Since the clamp members can move independently, they can move to the extent necessary to apply clamping pressure to different portions of a stack, even if those different portions of the stack are initially at different heights. This feature is important in clamping a stack folded signatures, because the folded edges of the signatures do tend to be at a different height than the unfolded edges.

In still another aspect of the invention, the clamping mechanism is designed to positively contain a stack of signatures when the stack is removed from the stacker and is being transported to a delivery position. A stack of signatures normally has a generally rectangular solid geometry, with four sides and two end surfaces. During the clamping process, the top and bottom clamping assemblies engage the two end surfaces, and one of the clamping assemblies also includes side retainer members for containing two opposite sides of a stack of signatures. Still further, the clamping mechanism includes a back retainer member which contains one of the remaining sides of a signature stack, and a pair of movable front retainer members which move into alignment with the final side of a signature stack after the stack has been withdrawn from a stacker, to complete the containment of the stack. Thus, the clamping mechanism contains all of the sides and the ends of the stack of signatures after the stack is withdrawn from the stacker.

BRIEF DESCRIPTION OF THE DRAWINGS

Additional features and advantages of the invention will become further apparent from the accompanying detailed description taken with reference to the accompanying drawings wherein.

DETAILED DESCRIPTION OF THE PREFERRED EMBODIMENT

Figure 1:
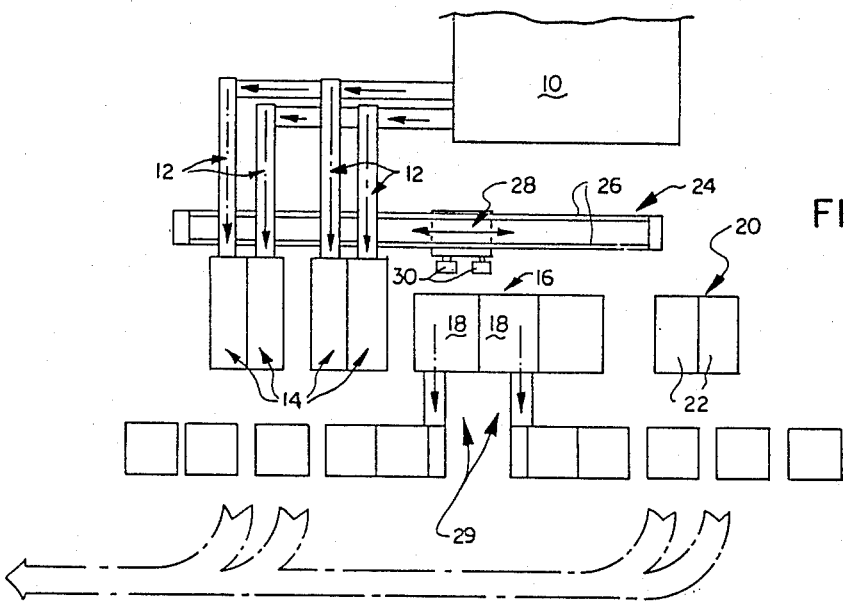
FIG. 1 is a schematic illustration of a signature handling system with a transfer vehicle embodying the principles of the invention.

As discussed above, a transfer vehicle with a clamping mechanism according to the invention is particularly useful in a signature handling system according to the two occurrances application of James Wise (U.S. Ser. No. 525,846), which is incorporated herein by reference. A system according to the principles of the aforesaid disclosure of Mr. Wise is shown schematically in FIG. 1. It includes a printing press 10, a plurality of delivery conveyors 12, each of which delivers signatures in overlapped, shingled fashion from the press 10, and a plurality of adjacent stackers 14, each disposed to receive signatures from a respective one of the delivery conveyors 12.

A tying station 16, comprising a pair of tyer mechanisms 18, is disposed adjacent the stackers 14. At the tying station 16, stacks of signatures can be tied into logs or bundles. An end board station 20, comprising a pair of end board supply mechanisms 22, is disposed adjacent the tying station 16. At the end board station 20, the transfer vehicle 28 can pick up end boards before it moves over to the stacker 14.

The transfer vehicle 28 moves along a guide track 24, which is defined by a pair of spaced, parallel rails 26 that run past the foregoing stations. The transfer vehicle 28 has a pair of special clamping mechanisms 30, each of which is formed according to the principles of the present invention. Each clamping mechanism 30 can receive a pair of end boards from the end board feeding station 20, clamp and remove a stack of signatures from a stacker 14 while associating one of the end boards with the stack, and leave the other end board with the stacker for association with a succeeding stack.

After removing a stack from the stacker 14, each clamping mechanism 30 is designed to completely contain the stack on all sides, and maintains that containment of the stack as it transfers the stack of signatures to the tying station 16 where the stack of signatures is tied into a log. At the tying station 16 a clamping mechanism 30 can be released from the stack of signatures to allow a tied stack of signatures to be removed from the tying station 16 and deposited on a further transporting conveyor system (shown generally at 29 in FIG. 1).

Figure 11:
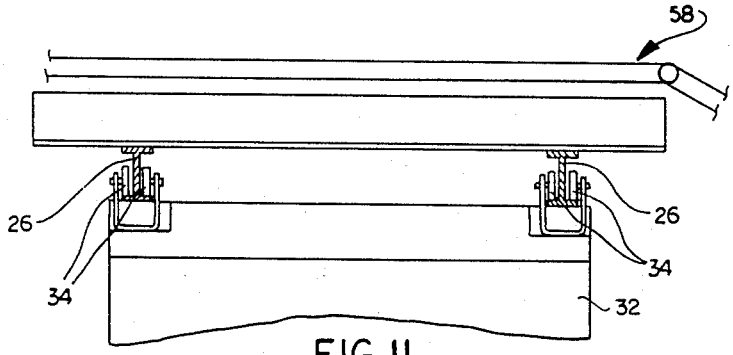
FIG. 11 schematically illustrates the structure for supporting the transfer vehicle for movement along a guide track.

The transfer vehicle 28 comprises a carriage 32 that is suspended from the rails 26 by a suspension system which includes rollers 34 that roll along the rails 26 to move the carriage 32 along the rails 26 (see FIG. 11). Each clamping mechanisms 30 is secured to the carriage 32 by longitudinally extending support rods 33 which can reciprocate laterally relative to the path of movement of the carriage 32 to move the clamping mechanism 30 between its extended and retracted positions. An air actuated cylinder 44 can drive the support rods 33 in either lateral direction for moving the clamping mechanism 30 between its extended and retracted positions.

In accordance with this invention, each clamping mechanism 30 includes a C-shaped frame 36 which is fixed to the support rods 33 and forms an outwardly facing front side 38 through which end boards and/or stacks of signatures can pass. The C-shaped frame 36 includes a back wall 37 which is fixed to the support rods 33, and top and bottom blocks 39, 41, respectively, which are fixed to the back wall 37. The back wall 37 has a back retainer member **37*a*** fixed thereto, and which retains the back side of a signature stack on the clamping mechanism.

Figure 6:
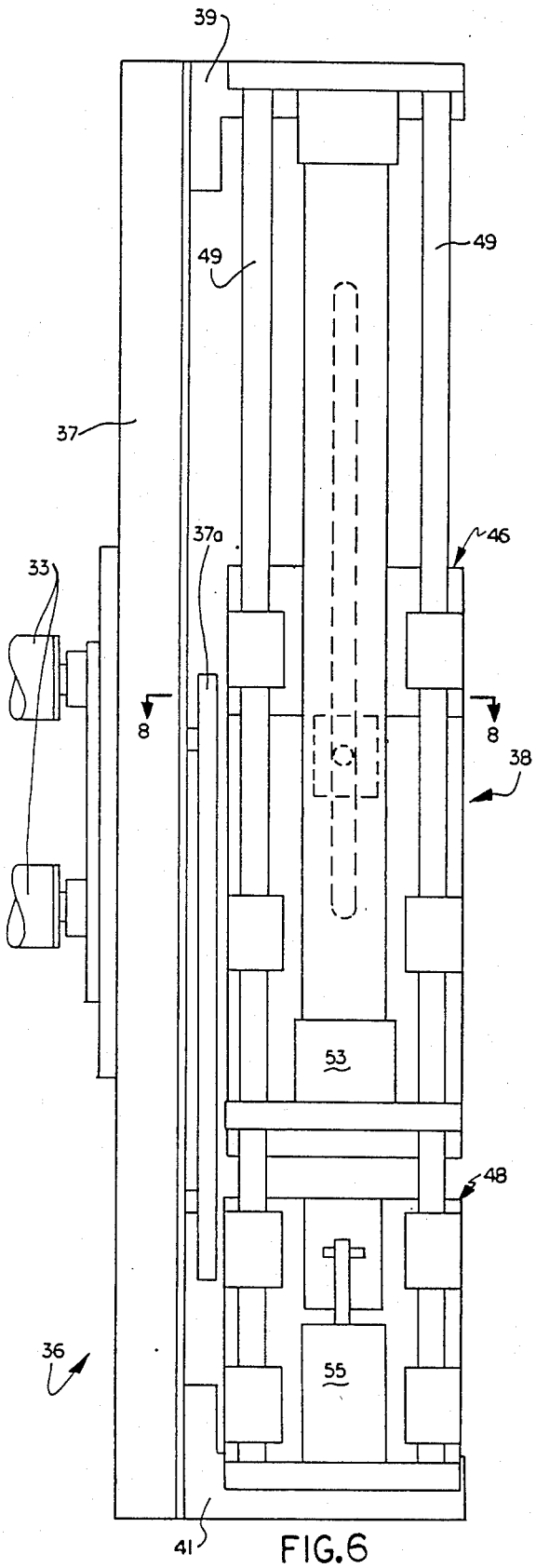
FIG. 6 is a side view of a clamping mechanism according to the principles of the invention.
Figure 7:
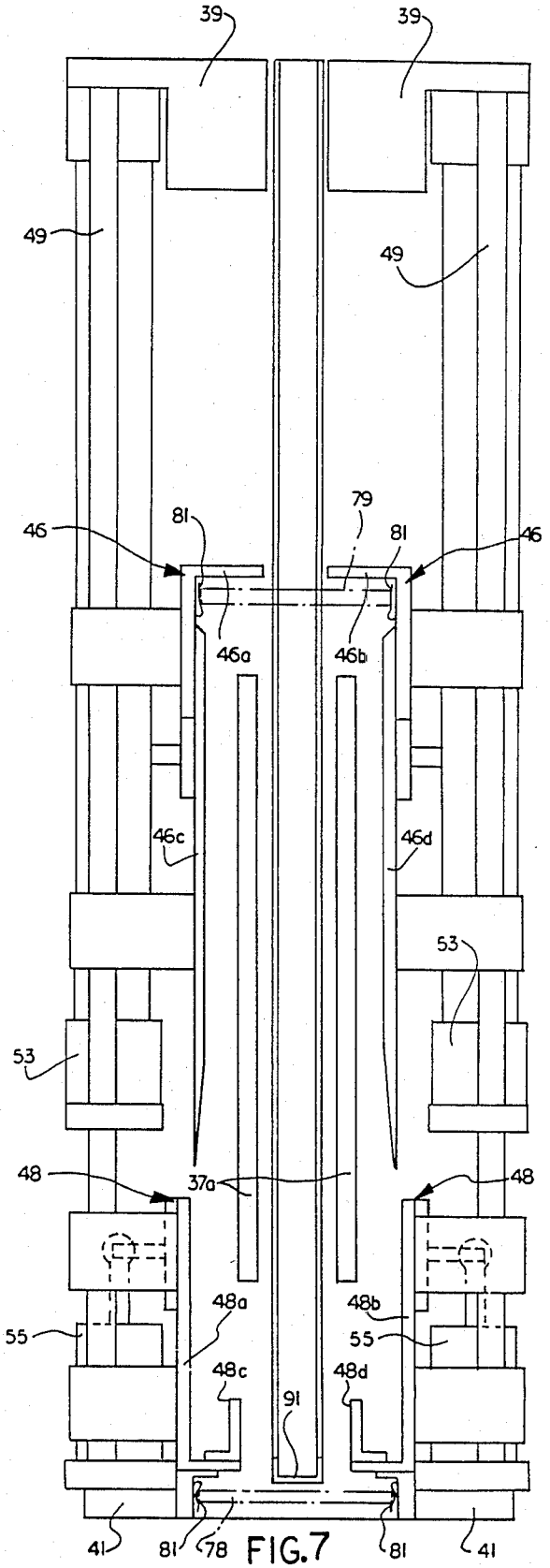
FIG. 7 is a view of a clamping mechanism according to the invention taken from the front (signature facing) side of the clamping mechanism.
Figure 8:
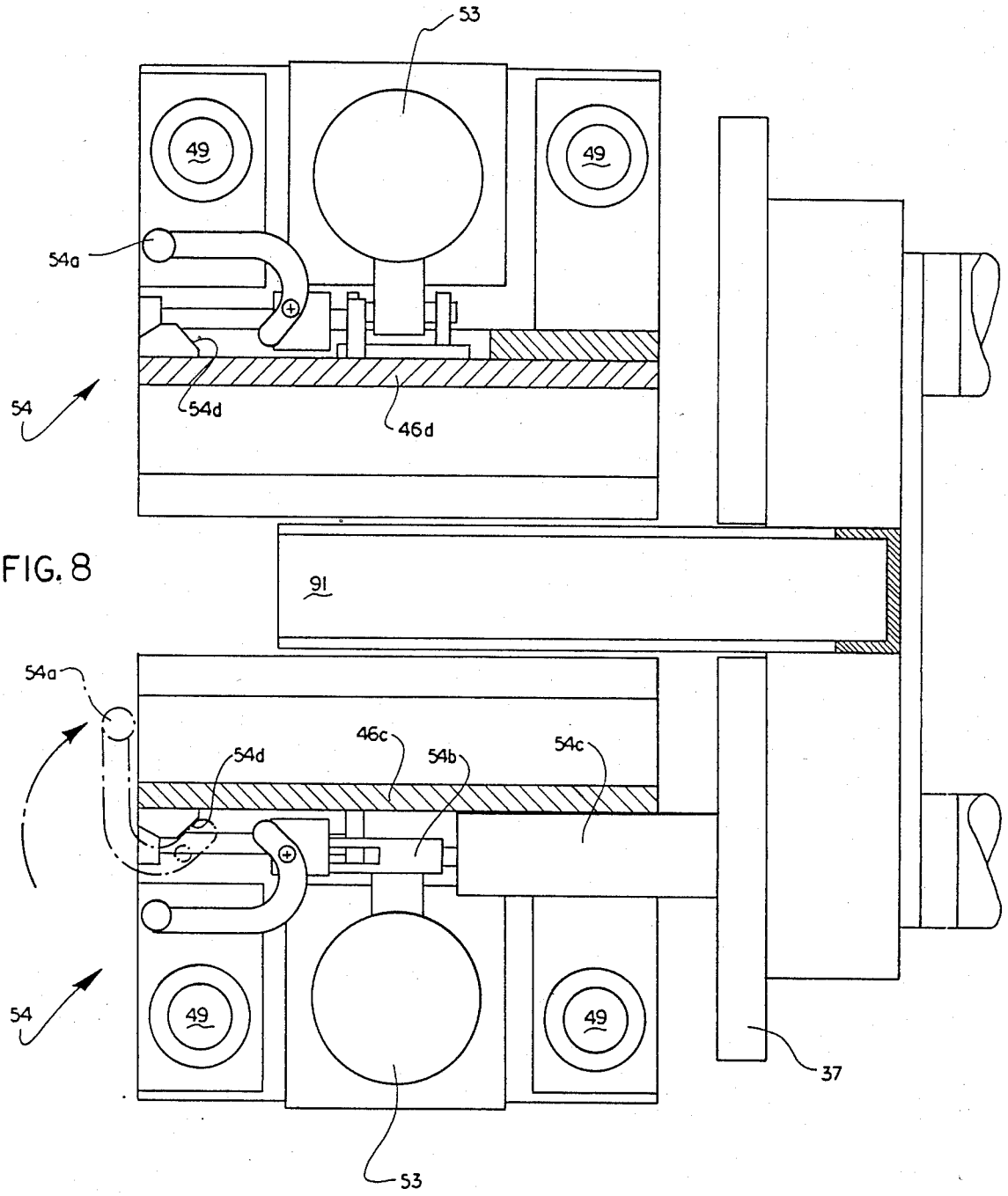
FIG. 8 is a sectional view of part of the clamping mechanism of FIG. 6, taken along the line 8—8, and showing the front retainer members.

A movable top clamp assembly 46 and a movable bottom clamp assembly 48 are connected to the C-shaped frame 36. Both clamp assemblies 46, 48 are supported, and guided for linear movement relative to the frame 36, by shafts 49 which extend between the top and bottom blocks 39, 41 (see FIGS. 6, 7). The top clamp assembly 46 preferably comprises a pair of clamp members **46*a*, 46*b*, each of which can be moved linearly along shafts 49 by operation of respective air cylinders 53 secured to those clamp members. The bottom clamp assembly 48 preferably comprises a pair of clamp members 48*a*, 48*b* which can be moved linearly along the shafts 49 by operation of respective air cylinders 55** secured to those clamp members.

The air cylinder 44, which shifts the clamping mechanism 30 between its restricted and extended positions, and the air cylinders 53, which move the top clamping members **46*a*, 46*b*** up and down, are preferably double acting rodless cylinders of a type manufactured by ORIGA Corporation, Elmhurst, Ill. They are shown in U.S. Pat. No. 3,820,446.

Figure 9:
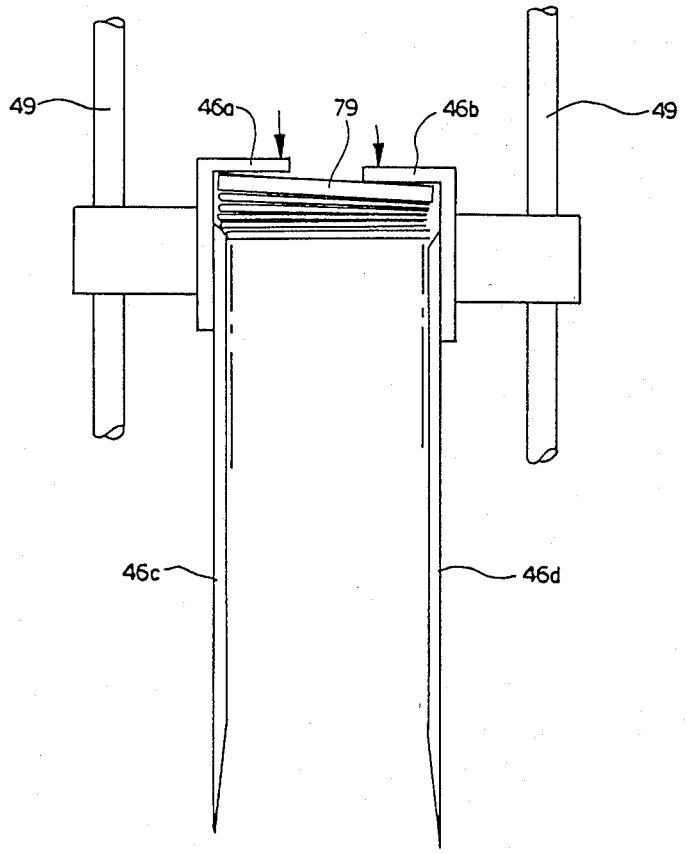
FIG. 9 is a fragmentary, schematic illustration of the way the top clamp members can move independently in clamping a stack of signatures.

The air cylinders 53 connected with the top clamp members **46*a*, 46*b*, are actuated simultaneously and from a common air supply. However, they are individually connected to their respective top clamp members 46*a*, 46*b*, so that the top clamp members 46*a*, 46*b* can move independently of each other in applying pressure to a stack. This feature is important when handling folded signatures, because the folded edges tend to be at a greater height than the edges due to (i) the folds themselves, and (ii) the trapping of air around the folded edges. With the top clamp members 46*a*, 46*b* being independently movable, as with the invention, the clamp members apply the needed clamping pressures to both the folded edges and the free edges of the signatures, so that both the folded and free edges of the signatures are adequately compressed during clamping (as shown schematically in FIG. 9**).

Figure 2:
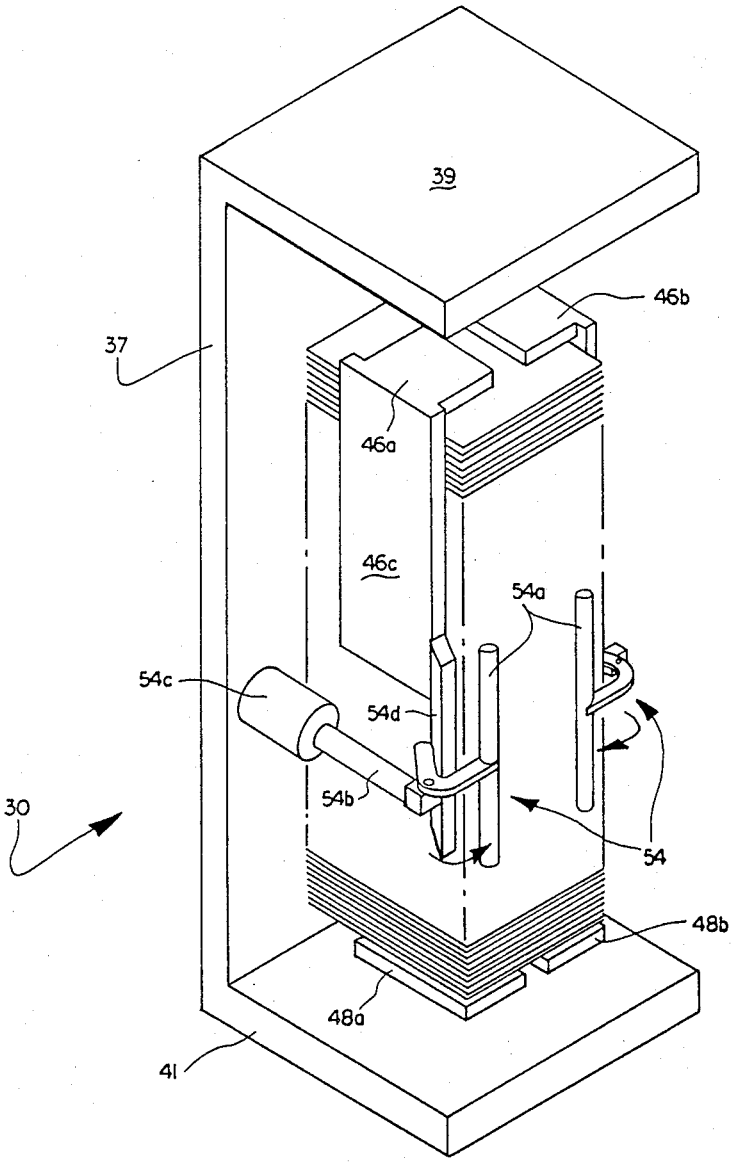
FIG. 2 is a schematic three dimensional illustration of a clamping mechanism containing a signature stack in accordance with the invention.

In accordance with a further feature of this invention, the clamping mechanism 30 is designed to positively contain a signature stack when the stack has been removed from a stacker 14. Specifically, as can be seen from the foregoing discussion, the back retainer member **37*a* contains the back side of a signature stack, and the clamp assemblies 46, 48 would contain the top and bottom ends of a signature stack. Furthermore, the movable top clamp members 46*a*, 46*b*, include integral downwardly depending side retainer members 46*c*, 46*d*, respectively, which retain two opposite sides of a stack of signatures when the stack is clamped between the top and bottom clamp assemblies 46, 48. Finally, to complete the containment, after the stack is removed from a stacker, a pair of front retainers 54 are pivoted into a position where they contain the front side of the signature stack. FIG. 2 schematically illustrtates a signature stack which is contained on both of its ends, and all of its sides, by the clamping mechanism 30**.

The front retainers 54 are preferably longitudinally extending bars **54*a* supported for pivotal motion on respective linearly movable shafts 54*b*. The linearly movable shafts 54*b* are connected with respective air cylinders 54*c*. A respective cam 54*d* that is fixed to each of the side retainer members 46*c*, 46*d* is associated with each front retainer 54. When the shaft 54*b* associated with a front retainer 54 is moved linearly, the front retainer engages the associated cam 54***d* and pivots into a position to retain the front side of a stack of signatures.

Each of the reciprocable top and bottom clamping assemblies 46, 48 carries a pair of spring fingers 81, and each pair of spring fingers 81 can engage an end board and carry the end board along with the clamping mechanism 30 over to a stack of signatures. One pair of spring fingers 81 extends downwardly from the top clamp members 46*a*, 46*b* forming the top clamp assembly 46. The other pair of spring fingers 81 extends downwardly from the bottom clamp members 48*a*, 48*b* forming the bottom clamp assembly 48. Each pair of spring fingers 81 is biased toward a condition in which it engages and apply a light gripping force to an end board (e.g., a top end board 79 and a bottom end board 78 as shown in phantom in FIG. 7) as the end board is being carried by the clamping mechanism 30 to a stacker 14.

Figure 5:
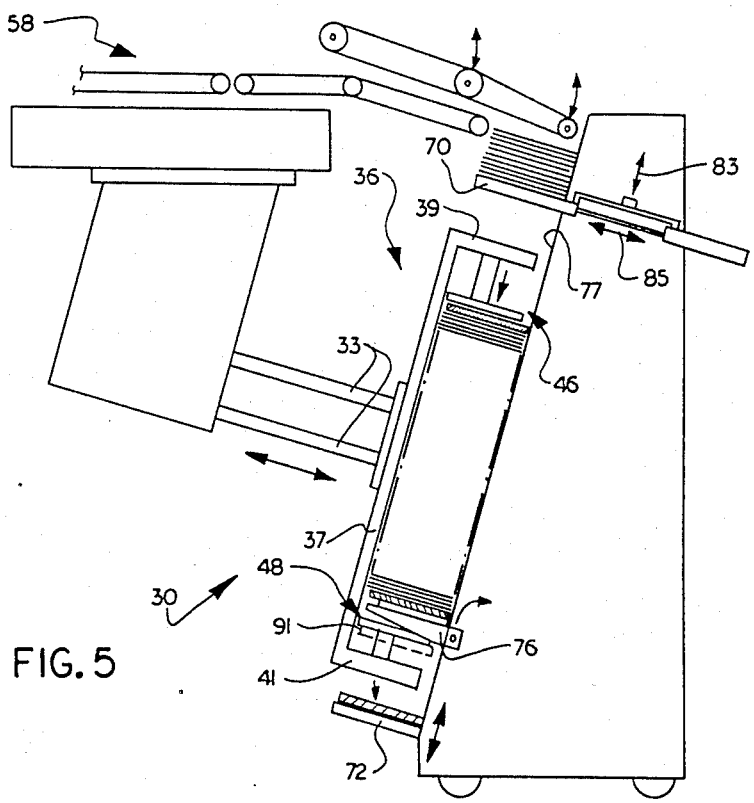

One of the stackers 14 is shown in FIG. 5. It is preferably constructed according to the concurrently filed application of Mohanjit Chandhoke and Michael Duke entitled "Apparatus for Forming a Stack of Signatures", application Ser. No. 518,015, which is assigned to the assignee of this application, and which is incorporated herein by reference. It includes an interceptor 70, a main fork 72, and an intermediate support member 76, all of which are shown in FIG. 5 at various locations along a slightly inclined, generally upright frame surface 77. The interceptor 70 can move along the frame surface 77, in the directions shown by arrows 83. It can also move transverse to the frame surface 77, as shown by the arrows 85. As the signatures arrive from the main conveyor 58, they begin to form a stack on the interceptor 70. The interceptor 70 can move downward along the frame surface 77 at a rate synchronized with the arrival of signatures so that the top of the stack always remains at about the same level.

The main fork 72 is mounted for reciprocating movement along the inclined frame surface 77, and forms a continuation of the path of the interceptor 70. The main fork 72 is connected with an endless chain 74 which is driven by one or more reversible motors (71, 71*a*), that are coupled to the chain 74 through a clutch and brake assembly 71*b*, and can drive the chain at different speeds. When a partially formed stack of signatures on the interceptor 70 has reached a predetermined size, it is transferred from the interceptor 70 to the main fork 72. The interceptor 70 is withdrawn from the path of the signatures during the transfer and the stack can continue to grow by moving the main fork 72 gradually downward along the inclined frame surface 77. The interceptor 70 is then returned to a position where it can, when directed, move back to its intercept position to intercept signatures from the main conveyor 58, to begin building another stack.

As the main fork 72 moves downwardly with the stack, it transfers the stack of signatures to the intermediate support member 76, which is disposed at a predetermined location along the inclined frame surface 77. The intermediate support member 76 supports the stack of signatures in a position to be engaged by a clamping mechanism 30. After transferring a stack to the intermediate support 76, the main fork 72 continues to move downwardly along the inclined frame surface 77 to an end board receiving position in which it can receive a lower end board for the next stack of signatures.

In handling a stack of signatures, the transfer vehicle 28 first moves to the end board pick-up station 20 where it receives pairs of top and bottom end boards 79, 78. The spring fingers 81 hold the top and bottom end boards 79, 78 as the clamping mechanism 30 moves from the end board feeding station 20 to the stackers.

Figure 4:
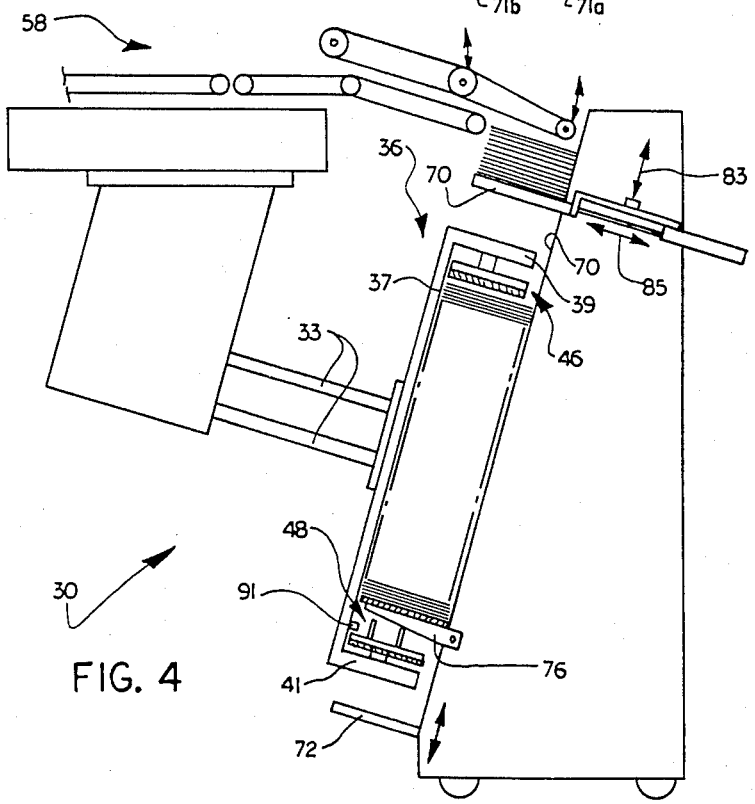

The transfer vehicle 28 then moves along the guide track 24 to a stack pickup position in which the clamping mechanism 30 is aligned with a respective stacker 14 (FIG. 5). On the stacker 14, a stack of signatures and a lower end board 78 are supported on the intermediate member 76. The clamping mechanism 30 is moved to an extended position, and as that happens, a stack of signatures on the intermediate member 76 of the stacker 14 passes through the front side 38 of the clamping mechanism, and is disposed between the upper and lower clamp assemblies 46, 48 (FIG. 4). The top and bottom clamp assemblies 46, 48 are then moved toward each other in order to press against the top and bottom ends of a stack of signatures in the stacker 14.

In clamping a stack, the air cylinders 55 are initially actuated, and the lower clamp members 48*a*, 48*b* are moved upward to lift the stack off the intermediate member 76. The lower clamp members 48*a*, 48*b* have upwardly extending fingers 48*c*, 48*d* that interdigitate with the intermediate support 76 when the lower clamp portions 48*a*, 48*b* are moved upwardly from the position shown in FIG. 4. Thus, as the lower clamp member 48*a*, 48*b* are moved upward through the intermediate support member 76, a stack and its associated lower end board are lifted off the intermediate member 76.

When the lower clamp members 48*a*, 48*b* have moved through a predetermined distance which causes them to lift the stack off the intermediate member 76, a limit switch is engaged by the lower clamp members to stop their movement. After the lower clamp members have lifted the stack off the intermediate member 76, the upper clamp members 46*a*, 46*b* are moved downward to press on the stack, thus pressing a top end board 79 against the top of the stack and clamping the stack between the clamp assemblies 46, 48. Air from a common supply is simultaneously directed to both cylinders 53 to move both clamp members 46*a*, 46*b* downward. The air pressure in the common air supply to the cylinders 53 can increase until a pressure switch senses that a predetermined pressure has been reached in the common air supply to the cylinders 53. At that point, the predetermined pressure is maintained, in order to maintain the clamp members 46*a*, 46*b* in clamping engagement with the stack.

Figure 3:
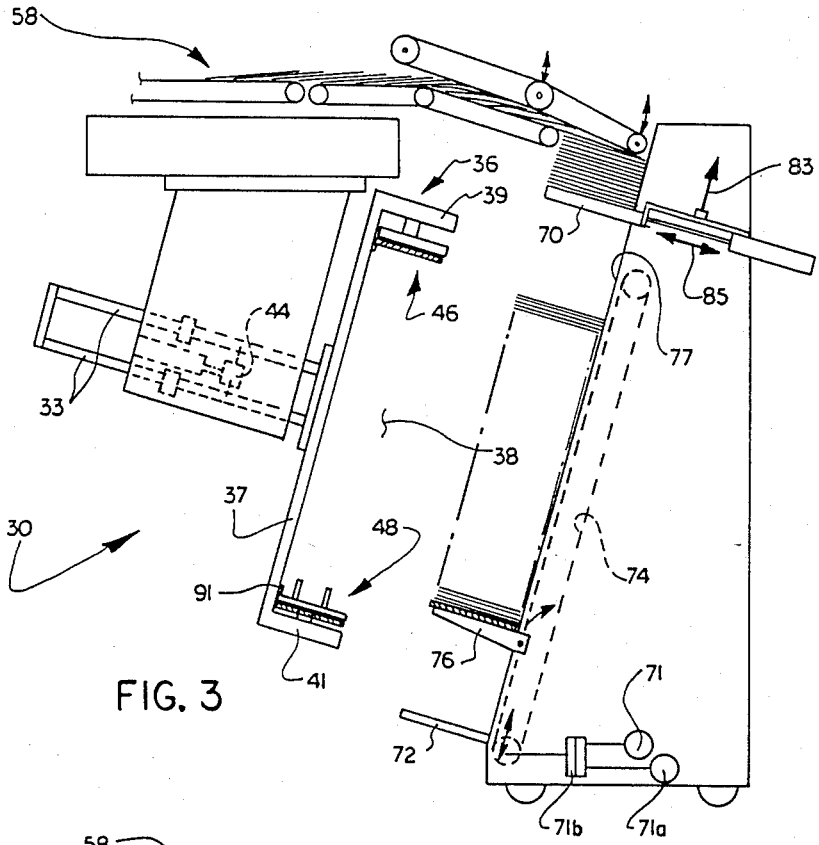
FIGS. 3–5 are schematic illustrations showing the manner in which a clamping mechanism according to the invention clamps a stack of signatures and deposits an end board on the stacker.
Figure 10:
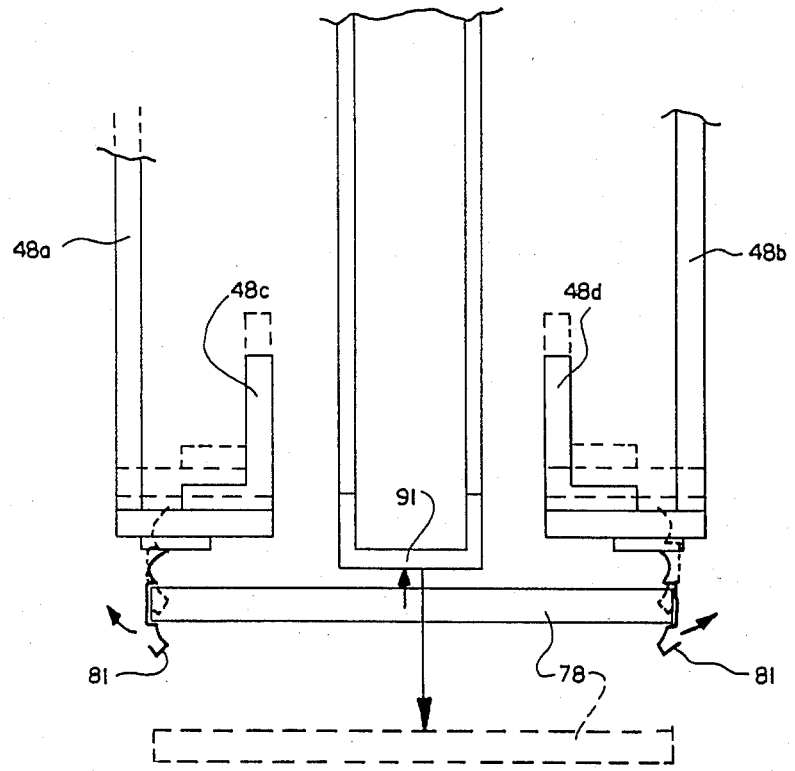
FIG. 10 is a fragmentary, schematic illustration of the bottom of the clamping mechanism, taken from the front side thereof, and showing the manner in which an end board supported at the bottom of the clamping mechanism is stripped from the clamping mechanism.

As the lower clamping members 48*a*, 48*b* move upward to lift the stack off the intermediate member 76, the lower end board 78, which is carried by the spring fingers 81 on the lower clamping members 48*a*, 48*b*, is stripped from the lower clamping members 48*a*, 48*b* and is dropped onto the main fork 72, which is disposed in a stack receiving position (FIG. 5) below the intermediate support 76. More specifically, as shown schematically in FIGS. 3–7, the frame 36 of the clamping mechanism 30 has a stripper 91 fixed thereto. The stripper 91 is disposed above the lower clamp assembly 48 when the clamping mechanism is in the postion of FIGS. 3, 4. When the bottom clamp assembly 48 moves upward from the position of FIG. 4 the bottom end board 78 engages the stripper 91 and is stripped from the spring fingers 81. Such action is shown schematically in FIGS. 5 and 10. The bottom end board 78 can then fall onto the main fork 72 at the end board receiving station. The stacker 14 then operates to associate that end board with the next succeeding stack, in accordance with the aforesaid application of Messrs. Chandhoke and Duke (Ser. No. 518,015).

Thus, the stack, with a pair of end boards disposed adjacent its ends, is clamped by the clamping mechanism 30. The clamping mechanism is now retracted to remove the stack from the stacker 14 while maintaining clamping engagement with the stack. After the clamping mechanism 30 is clear of the stacker 14, the front retainers 54 are pivoted into the position shown in FIG. 2, to complete the containment of the stack.

After removing a stack from the stacker 14, the transfer vehicle 28 moves the stack to the tyer station 16. While moving the stack, the air pressure which operated the clamping assemblies 46, 48 is maintained, and the clamping mechanism 30 maintains clamping engagement with the stack. Thus, there is little, if any, chance for the stack to become disarrayed as it is being moved. At the tying station, a strap guide is formed around the stack, and a strap or band is guided through the strap guide and around the stack and drawn into tight engagement with the stack to tie the stack. In accordance with the aforesaid application of James Wise (Ser. No. 525,840), the strap guide is partially formed on the clamping mechanism 30 and partially formed at the tying station. Further, it should be noted that a portion of the strap guide is utilized to form the stripper 91 of the present invention.

After a stack is successfully tied, the clamping mechanism 30 releases the stack, and the clamping mechanism is retracted from the tied stack. Thus, the tied stack is left on the tyer mechanism 18. It can then be removed from the tyer mechanism 18, and delivered to the further handling system 29.

Figure 12:
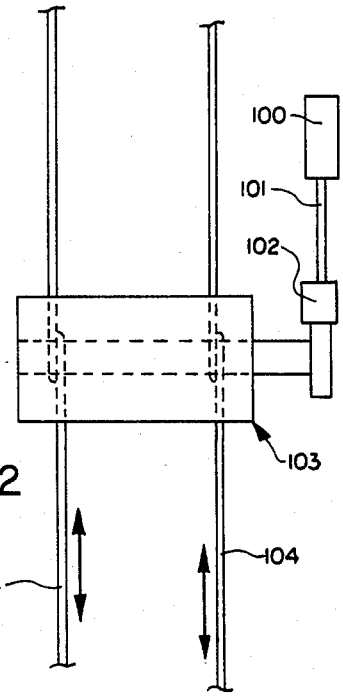
FIG. 12 schematically illustrates the operating principles of the drive mechanism which propels the transfer vehicle along the guide track between the various stations.

The principles by which the transfer vehicle 28 is propelled along its guide path is shown in FIG. 12. An air motor 100 can drive a linear actuator 101 in either of two directions. In turn, the actuator 101, through a gear box 102, turns a shaft disposed within a drum 103 in one direction. Depending on which way the shaft turns, a pair of bands 104 are wound in one direction and unwound in the other. Thus, the transfer vehicle is pulled along the guide track.

What is claimed is:

1. Apparatus for engaging a stack of signatures on a stacker and for removing the stack of signatures from the stacker, said apparatus comprising a transfer vehicle which can move toward a stack of signatures on the stacker, a clamping mechanism connected with the transfer vehicle to clamp the stack, said transfer vehicle being movable away from the stacker to move from the stacker a set of signatures clamped by said clamping mechanism, said clamping mechanism comprising a pair of clamp assemblies that are movable toward each other to clamp the stack therebetween, at least one of said clamp assemblies including a pair of clamp members, and means for moving said clamp members in said one clamp assembly linearly and independently of each other to apply pressure to at least two points at one end of the stack to insure adequate compression of the stack even at different initial height of the stack at said two points.

2. Apparatus as defined in claim 1 wherein said means for moving said pair of clamp members comprises a pair of air actuated cylinders, each of said air actuated cylinders being associated with one of said clamp members, the air actuated cylinders associated with said clamp members being simultaneously actuatable to move their respective clamp members linearly toward clamping engagement with the stack, and said clamp members being movable independently of each other in applying clamping pressure to respective portions of the stack.

3. Apparatus comprising a transfer vehicle having a clamping mechanism for engaging and clamping a stack of signatures being supported on a stacker, said clamping mechanism further including means for retaining a pair of end boards prior to engaging the stack of signatures supported on a stacker, said means for retaining a pair of end boards comprising a first spring finger means for retaining one of said pair of end boards and a second spring finger means for retaining the other of said pair of end boards, said clamping mechanism including means for clamping said one of said pair of end boards against one end of the stack and means for stripping said other of said pair of end boards from said second spring finger means and depositing that other end board onto the stacker as the clamping mechanism is engaging and clamping a stack of signatures on the stacker.

4. Apparatus as set forth in claim 3 wherein said clamping mechanism comprises a top clamp assembly and a bottom clamp assembly, said top and bottom clamp assemblies being movable toward each other to clamp a stack of signatures therebetween, said means for clamping one end board against a stack of signatures comprising first spring finger means disposed to engage and hold an end board adjacent the top clamping assembly in position to be pressed between said top end board clamp assembly and the top of a stack of signatures when the top and bottom end board assemblies are moved toward each other, said means for depositing the other end board comprising second spring finger means disposed to engage and hold the other end board on said bottom clamp assembly and depending freely therefrom, and stripper means fixed to said clamping mechanism and disposed to engage a bottom end board and strip it from engagement with the spring second finger means during movement of the bottom clamp assembly toward the top clamp assembly.

5. Apparatus for engaging a stack of signatures on a stacker and for removing the stack of signatures from the stacker, the stack of signatures having a generally rectangular solid profile with four sides and two ends, said apparatus comprising a transfer vehicle having a clamping mechanism which can move toward a stack of signatures on a stacker to engage and clamp the stack and which can move away from the stacker to remove a clamped set of signatures from the stacker, said clamping mechanism having means for containing both ends and all four sides of the stack of signatures when the clamping mechanism has removed the stack of signatures from the stacker.

6. Apparatus as defined in claim 5 wherein said clamping mechanism comprises a frame having a back wall, and a top and bottom wall fixed to said back wall, said back and top walls comprising a C-shaped frame having an opening for receiving a stack of signatures that are being clamped by the clamping mechanism, said back wall having a back retainer for containing one side of a stack of signatures, said clamping mechanism including movable top and bottom clamp assemblies that are movable toward each other for engaging and containing the ends of a stack of signatures during the clamping process, at least one of said movable top and bottom clamp assemblies including a pair of side retainer members for containing two opposite sides of the stack of signatures, and a pair of front retainer members movable into the front opening in the C-shaped frame and disposed in facing relation with the remaining side of a stack of signatures to complete the containment of the signatures.

* * * * *